US006446727B1

(12) United States Patent
Zemlak et al.

(10) Patent No.: US 6,446,727 B1
(45) Date of Patent: Sep. 10, 2002

(54) PROCESS FOR HYDRAULICALLY FRACTURING OIL AND GAS WELLS

(75) Inventors: Warren M. Zemlak; Stephen P. Lemp, both of Calgary; Robert D. Thiessen, Red Deer, all of (CA)

(73) Assignee: Sclumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/240,125

(22) Filed: Jan. 29, 1999

Related U.S. Application Data

(60) Provisional application No. 60/108,119, filed on Nov. 12, 1998.

(51) Int. Cl.[7] ..... E21B 43/26
(52) U.S. Cl. ..... 166/308; 166/177.5
(58) Field of Search ..... 166/308, 177.5, 166/280, 281, 297, 384

(56) References Cited

U.S. PATENT DOCUMENTS

| | | | | | |
|---|---|---|---|---|---|
| 3,455,387 | A | | 7/1969 | Peters | 166/278 |
| 4,372,384 | A | | 2/1983 | Kinney | 166/278 |
| 4,442,895 | A | * | 4/1984 | Lagus et al. | 166/250.1 |
| 4,615,825 | A | | 10/1986 | Teot et al. | 516/67 |
| 5,085,276 | A | * | 2/1992 | Rivas et al. | 166/303 |
| 5,103,911 | A | * | 4/1992 | Heijnen | 166/297 |
| 5,265,678 | A | * | 11/1993 | Grundmann | 166/308 |
| 5,287,741 | A | | 2/1994 | Schultz et al. | 73/152.5 |
| 5,353,875 | A | | 10/1994 | Schultz et al. | 166/297 |
| 5,373,899 | A | | 12/1994 | Dore et al. | 166/278 |
| 5,409,061 | A | * | 4/1995 | Bullick | 166/278 |
| 5,417,284 | A | * | 5/1995 | Jones | 166/280 |
| 5,427,177 | A | | 6/1995 | Jordan, Jr. et al. | 166/50 |
| 5,472,049 | A | * | 12/1995 | Chaffee et al. | 166/250.1 |
| 5,501,275 | A | | 3/1996 | Card et al. | 166/280 |
| 5,551,516 | A | | 9/1996 | Norman et al. | 166/308 |
| 5,722,490 | A | | 3/1998 | Ebinger | 166/281 |
| 5,755,286 | A | | 5/1998 | Ebinger | 166/281 |
| 5,947,200 | A | * | 9/1999 | Montgomery | 166/281 |
| 5,954,133 | A | * | 9/1999 | Ross | 166/297 |
| 6,070,666 | A | * | 6/2000 | Montgomery | 166/308 |

OTHER PUBLICATIONS

M.P. Cleary et al., "Major New Developments in Hydraulic Fracturing, with Documented Reductions of Job Costs and Increases in Normalized Production", SPE 28565, pp. 547–562, Paper prepared for presentation on Sep. 25–28, 1994.

Statement Regarding Documents for Gas Well Treated Feb. 1996 (with attachments).

* cited by examiner

*Primary Examiner*—David Bagnell
*Assistant Examiner*—Jennifer R Dougherty
(74) *Attorney, Agent, or Firm*—John E. Vick, Jr.; Brigitte L. Jeffery; John J. Ryberg

(57) ABSTRACT

A wellbore (10) in an earth formation (12) having a casing (14) and a plurality of pay or production zones (32, 34, 36) provided in the formation. A coiled tubing string (18) from a reel (20) is injected by an injector (24) into the wellbore (10) for first perforating casing section (38) at each pay zone (32, 34, 36) in a single pass of the coiled tubing (18) as shown in FIG. 1. Next, the coiled tubing (18) is utilized for hydraulic fracturing each of the pay zones (32, 34, 36) individually from the lowermost pay zone (32) to the uppermost pay zone (36) in a single pass of the coiled tubing (18). Each pay zone (32, 34, 36) is isolated for the hydraulic fracturing. An upper packer (44 or 54) is provided above each of the pay zones for isolation and a lower packer (56) or sand plug (50) is utilized for isolating the lower or outermost end of each pay zone (32, 34, 36). Swab cups (58, 54A, 56A, 54B, 56B) are also utilized for isolation of pay zones.

9 Claims, 4 Drawing Sheets

22
24
20
16
12
10
18
14
30
26
36
28
26
34
28
26
38
32
37

22
24
20
16
12
10
18
14
38
36
38
34
44
38
40
48
32
37

PROCESS FOR HYDRAULICALLY FRACTURING OIL AND GAS WELLS

CROSS REFERENCE TO RELATED PROVISIONAL APPLICATION

This application claims the benefit of U.S. Provisional Application No. 60/108,119 filed Nov. 12,1998.

FIELD OF THE INVENTION

This invention relates to a process for hydraulically fracturing oil and gas wells utilizing coiled tubing, and particularly to such a process in which the oil and gas wells have multiple production or pay zones.

BACKGROUND OF THE INVENTION

Hydraulic fracturing is a term that has been applied to a variety of methods used to stimulate the production of fluids such as oil, natural gas, brines, etc., from subterranean formations. In hydraulic fracturing, a fracturing fluid is injected through a wellbore and against the face of the formation at a pressure and flow rate at least sufficient to overcome the minimum principal stress in the reservoir and extend a fracture(s) into the formation. The fracturing fluid usually carries a proppant such as 20–40 mesh sand, bauxite, glass beads, etc., suspended in the fracturing fluid and transported into a fracture. The proppant then keeps the formation from closing back down upon itself when the pressure is released. The proppant filled fractures provide permeable channels through which the formation fluids can flow to the wellbore and thereafter be withdrawn.

Hydraulic fracturing has been used for many years as a stimulation technique and extensive work has been done to some problems present at each stage of the process. For example, a fracturing fluid is often exposed to high temperatures and/or high pump rates and shear which can cause the fluids to degrade and to prematurely "drop" the proppant before the fracturing operation is completed. Considerable effort has, therefore, been spent trying to design fluids that will satisfactorily meet these rigorous conditions.

High permeability formations such as those having permeabilities in excess of 50 millidarcy and particularly in excess of 200 millidarcy, present special challenges, especially when the reservoir temperature is above about 400° F. In these situations, the amount of fluid lost to the formation can be very high, resulting in increased damage and decreased fracture length. Further, the difference in permeability between the formation and the fracture is less than that realized in less permeable formations. Improved fracture cleanup is therefore necessary in order to maximize well productivity.

A wide variety of fluids has been developed, but most of the fracturing fluids used today are aqueous based liquids which have been engineered for use in low permeability formations and are generally not well suited for use in higher permeability formations.

It has been common heretofore for the hydraulic fracturing of old oil and gas wells to utilize a workover rig and wireline for setting a packer and bridge plug combination about jointed tubing for isolation of each production zone for hydraulic fracturing. Such a fracturing operation is time consuming. For example, in a gas well with four production zones, the completions involving a fracturing and workover program may take about ten to fifteen days. If hydraulic fracturing is provided individually with a workover rig for each production zone in a multiple zone well, multiple trips to the well for perforating and multiple trips to the well for hydraulic fracturing are required. Obviously, substantial time and expense are involved with such a process utilizing a workover rig or other isolation methods.

However, prior. art processes have been utilized heretofore in which coiled tubing without a workover rig has been used for fracturing a gas reservoir. Upper and lower mechanical packers were utilized on upper and lower sides of the production zones. The setting and release of the mechanical packers were required for each pay zone. For example, U.S. Pat. No. 5,427,177 dated Jun. 27, 1995 shows the utilization of coiled tubing particularly for the completion of lateral wells and multilateral wells. A re-entry tool on coiled tubing has a plurality of inflatable casing packers thereon to block the annulus and permit various operations such as fracturing or acidizing.

It is an object of this invention to provide a process for hydraulically fracturing oil and gas wells having multiple pay zones utilizing a coiled tubing string and fracturing the desired pay zones in a single pass of the coiled tubing string.

Another object of the invention is to provide such a process in which the multiple pay zones are perforated prior to the hydraulic fracturing of the pay zones.

A further object of the invention is to provide such a process for fracturing a multizone well with coiled tubing in which a fracturing fluid is utilized which has a low friction for minimizing the fluid pressure within the coiled tubing during the fracturing process.

Another object of the invention is to provide a process for fracturing a multizone well with coiled tubing in which each selected pay zone is isolated separately in a minimum of time while utilizing the associated coiled tubing string with the coiled tubing movable after fracturing to another pay zone for isolation of subsequent pay zones.

SUMMARY OF THE INVENTION

This invention is directed to a process for hydraulically fracturing of oil and gas wells having multiple pay zones utilizing coiled tubing with the multiple pay zones fractured with a single pass of the coiled tubing. Each pay zone is individually isolated and fractured. Prior to fracturing the multiple pay zones are perforated in a single pass of a wireline or a coiled tubing string. The pay zones are isolated with a sand plug on a lower end of a pay zone or with swab cups.

For hydraulic fracturing of the multiple pay zones after the zones have been perforated, the lowermost or farthermost pay zone is initially hydraulically fractured, then the bottom hole assembly on the end of the coiled tubing is moved to the perforation at the next pay zone for hydraulic fracturing. This sequence continues until all of the very zones have been individually fractured and stimulated.

For isolation of each pay zone in one embodiment, a mechanical packer is positioned adjacent the upper side of the pay zone and after fracturing, a sand plug is deposited adjacent the lower side of the pay zone. Then, upon release of the mechanical packer, the coiled tubing string is raised to the next pay zone. For the lowermost pay zone, a bridge plug may sometimes be utilized without a sand plug, and for the uppermost pay zone, a wellhead hanger may sometimes be utilized adjacent the upper end of the pay zone for isolation without requiring a mechanical packer.

For isolation of each pay zone in another embodiment, swab cups may be utilized at opposed sides or ends of the pay zone. In one embodiment, a downwardly facing swab cup is positioned adjacent the upper end of the pay zone and a sand plug is provided after fracturing adjacent the lower end of the pay zone. In another embodiment, a downwardly facing swab cup is positioned adjacent the upper end of each pay zone and an upwardly facing swab cup is positioned adjacent the lower end of each pay zone for isolating each pay zone prior to hydraulic fracturing. The swab cups are normally spaced from each other a distance generally equal to the maximum thickness pay zone. Then, upon movement of the coiled tubing string to an adjacent pay zone, the swab cups do not have to be adjusted unless the thicknesses of the pay zones are widely different. Swab cups do not require setting and releasing. Thus, the swab cups and coiled tubing string can be moved quickly to subsequent pay zones. If desired, a plurality of swab cups may be provided on each side of a pay zone for isolation of the pay zone.

The fracturing material utilized with the coiled tubing of this invention provides a low friction against the coiled tubing when flowing therein to minimize the pressure in the coiled tubing which are particularly desirable at depths over about 4,500 feet. Coiled tubing normally has an external diameter of between 1 ¾ inches and 2 ⅜ inches and in some instances as great as 2 ⅞ inches. Friction from the fracturing material can be reduced by reducing the rate of injection or by increasing the diameter of the coiled tubing. A low injection rate is normally undesirable for placement of the proppant and for effective fracturing of the formation. Coiled tubing has operating limitations and it is necessary that fluid pressure within the coiled tubing be within the operating range of the coiled tubing. A fracturing fluid for a specific job is selected based primarily on (1) the friction, (2) the surface pressure limitation, (3) the safe operating limits of the coiled tubing, (4) the desired fracture geometry, and (5) the characteristics of the formation. The use of a fracturing fluid having a low friction permits the utilization of a smaller diameter coiled tubing in many instances, particularly at depths over 4,500 feet. For example, at formations at about 7,000 feet in depth, a low friction fluid may be used for fracturing whereas a higher friction fluid is generally limited to substantially shallower formations.

Other features and advantages will be apparent from the following specification and drawings.

DESCRIPTION OF THE INVENTION

Figure 1:
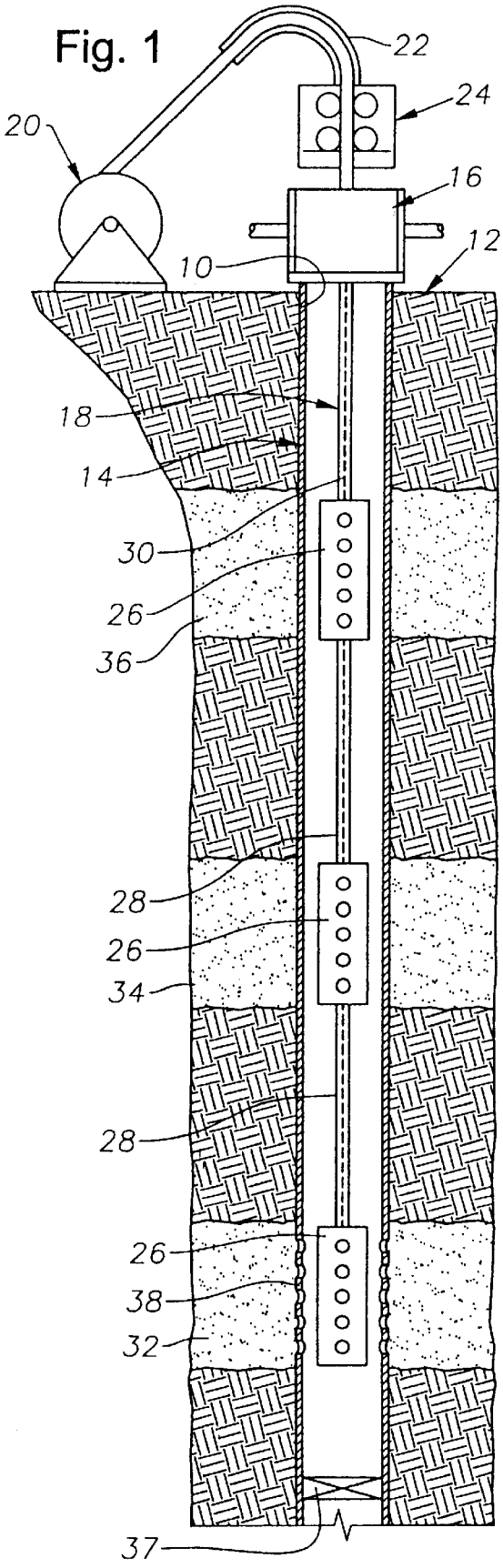
FIG. 1 is a schematic view of a typical multiple pay zone wellbore showing perforating means suspended from coiled tubing for perforating each of the pay zones of the wellbore in a single trip of the coiled tubing.

This invention is directed particularly to a process of hydraulically fracturing a multiple pay zone wellbore with coiled tubing in one trip of the coiled tubing. The process also includes the perforation of the multiple pay zones with a wireline or coiled tubing prior to the hydraulic fracturing in a single pass of the wireline as shown in FIG. 1.

A wellbore for an oil or gas well is generally indicated at 10 in an earth formation 12 and has a casing 14 connected to a wellhead generally indicated at 16. A coiled tubing string 18 is wound on a reel 20 and extends from reel 20 over a gooseneck 22 to an injector 24 positioned over wellhead 16 for injecting the coiled tubing string 18 through wellhead 16 within casing 14 as well known. Suspended from the lower end of the coiled tubing string 18 are a plurality of perforating guns 26 connected by a cable 28. A wireline 30 positioned within coiled tubing 18 is connected to perforating guns 26 for selective detonation of perforating guns 26 from a surface location. In some instances, wireline 30 may be utilized without the coiled tubing 18 and suspend perforating guns 26. Perforated guns may be detonated individually or may be detonated simultaneously depending primarily on the configuration of the well.

Earth formation 12 has a plurality of spaced production or pay zones including a lowermost zone 32, an intermediate zone 34, and an uppermost zone 36. Zones 32, 34, and 36 are formed of an earth material having a high permeability in excess of 50 millidarcy for example. A bridge plug 37 is positioned in casing 14 adjacent the bottom of casing 14 below lowermost pay zone 32. Casing 14 is perforated at pay zones 32, 34, 36 in a single pass of the coiled tubing string 18 commencing with the lowermost pay zone 32. Lower perforating gun or head 26 is detonated when aligned with pay zone 32. Coiled tubing string 18 is then raised until the intermediate perforating gun 26. is adjacent pay zone 34 for detonation. The coiled tubing string 18 is next raised until the uppermost perforating gun 26 is in alignment with pay zone 36 and is then detonated utilizing wireline 30. The casing 14 is then perforated along casing sections 38 for pay zones 32, 34, and 36 as shown particularly in FIG. 2. If desired for some applications, perforating guns 26 may be initially aligned with pay zones 32, 34, 36 and detonated simultaneously.

Figure 2:
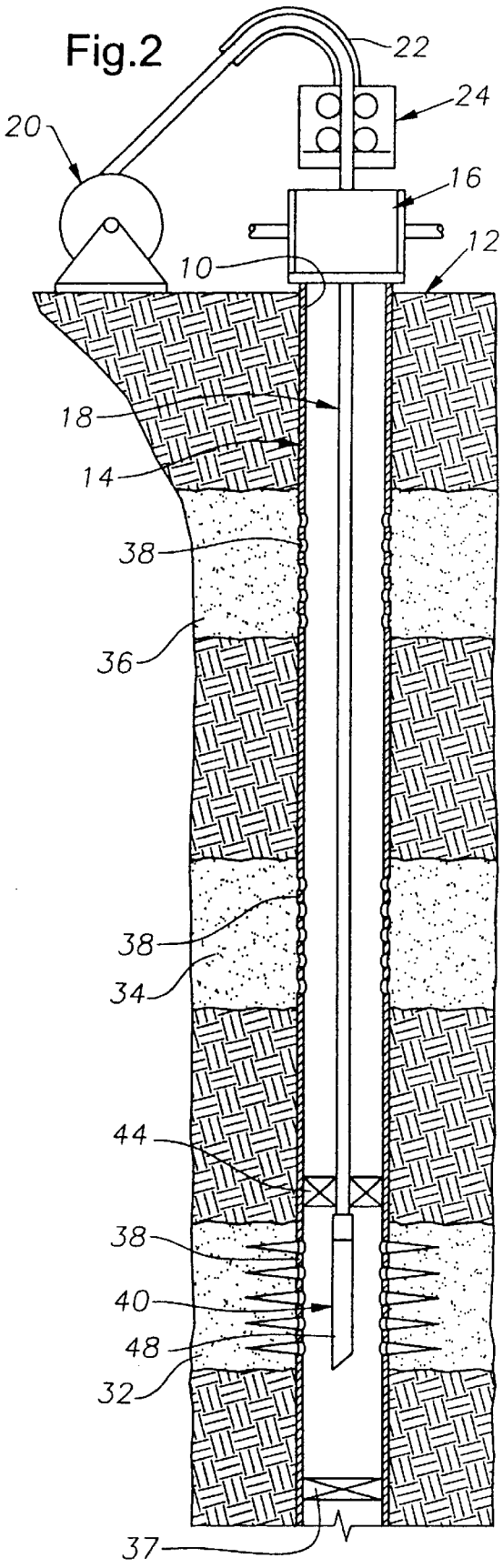
FIG. 2 is a schematic view of the multiple pay zone wellbore shown in FIG. 1 but showing coiled tubing suspending a bottom hole assembly for hydraulic fracturing of each of the pay zones in sequence from the lowermost pay zone to the uppermost pay zone and showing the bottom hole assembly in position for hydraulic fracturing of the lowermost pay zone.
Figure 3:
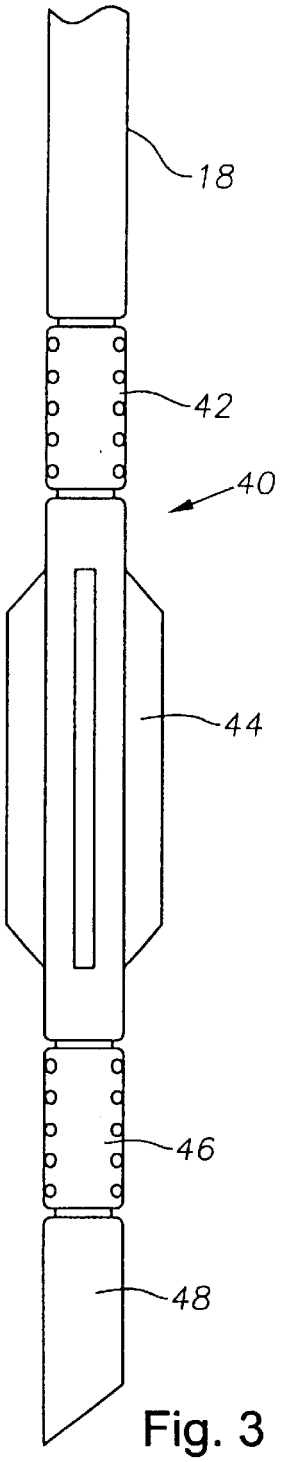
FIG. 3 is an elevational view of a suitable bottom hole assembly suspended from the coiled tubing for hydraulic fracturing of the pay zones.

As shown in FIG. 2, coiled tubing string 18 has a bottom hole assembly generally indicated at 40 suspending within casing 14 adjacent the lowermost pay zone 32 and arranged for hydraulically fracturing lowermost pay zone 32 adjacent perforated casing section 38. As shown particularly in FIG. 3, bottom hole assembly 40 includes a grapple connector 42 connected to tubing string 18 and a tension set packer indicated at 44. A tail pipe connector 46 is connected to packer 44 and a tail pipe 48 extends downwardly from tail pipe connector 46. A tension set packer which has been found to be satisfactory is a Baker Model AD1 packer sold by Baker Hughes, Inc., of Houston, Tex. Packer 44 is shown schematically in set position above the upper end of lowermost pay zone 32 in FIG. 3 and end tail pipe 48 extends downwardly therefrom. The low friction fracturing material in the form of a slurry is discharged from tail pipe 48 at a predetermined pressure and volume for flowing into the permeable formation adjacent perforated casing section 38. After zone 32 has been fractured with the predetermined low friction fracturing material and stabilized with a predetermined amount of the fracturing material, the slurry system is switched to a flush position and sufficient sand is added to form a sand plug in casing 14. The pumping system is then shut down and the sand settles to form a sand plug shown at 50 in FIG. 4 across the perforations adjacent the lower end of the perforated section 38 and extending above perforated section 38.

Figure 4:
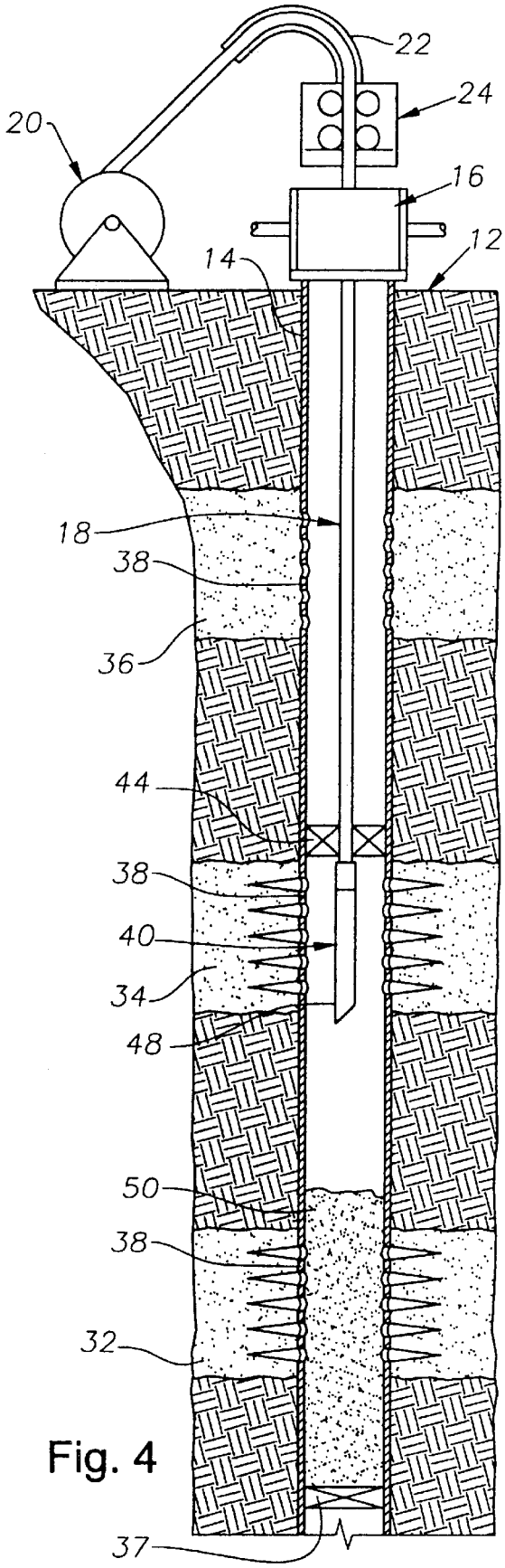
FIG. 4 is a schematic view similar to FIG. 2 but showing the bottom hole assembly in position for hydraulic fracturing of the second pay zone from the bottom of the wellbore with a sand plug within the wellbore covering the perforations in the lowermost pay zone which has been hydraulically fractured.

After it has been determined that sand plug 50 is in place, packer 44 is released and the bottom hole assembly 40 raised or pulled to the next pay zone 34. Packer 44 is then set at a position about twenty (20) meters, for example, above the uppermost perforations in casing section 38. The process is then repeated for pay zone 34 as shown in FIG. 4. The sand plug 50 for each pay zone 32, 34, 36 is sufficient to cover the perforations in each of the pay zones so that an adequate sand plug is provided for isolation of each of the pay zones. The sand plug is formed at the end of the fracturing process by increasing the sand concentration in the slurry to provide the desired sand plug. After the pump is shut down, the sand settles to form the sand plug across the adjacent perforations.

Figure 5:
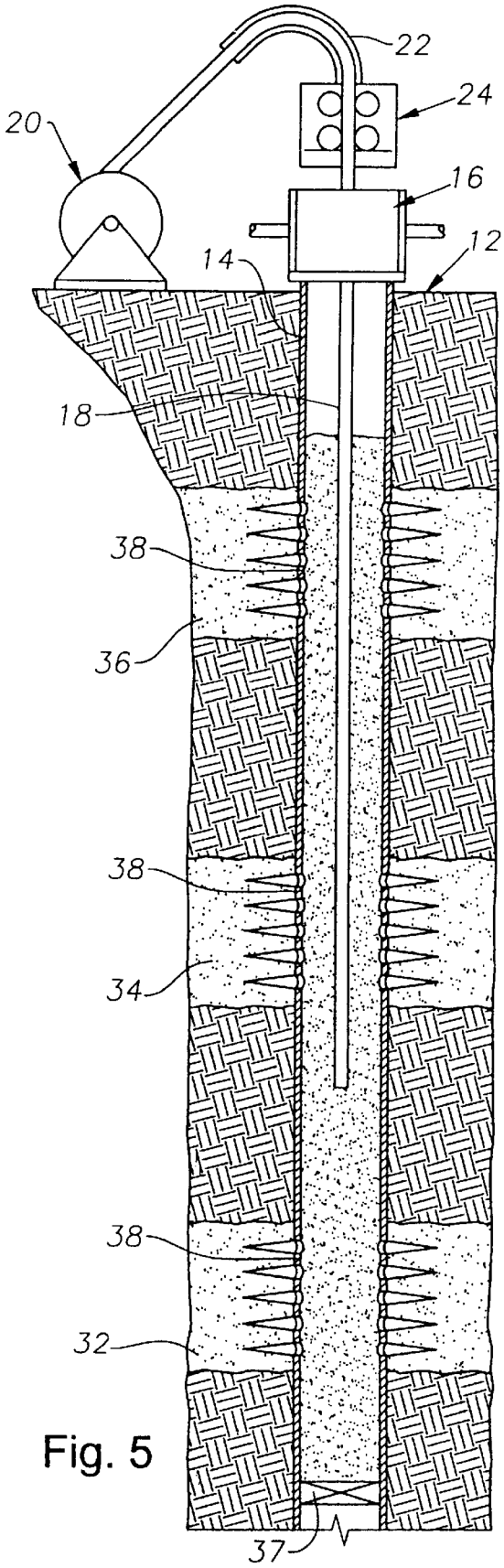
FIG. 5 is a schematic view of the wellbore shown in FIGS. 2 and 4 with the fracturing operation completed and sand within the wellbore being washed out for production.

After providing the sand plug for pay zone 34, the tension packer 44 is released and the bottom hole assembly 40 raised to the next pay zone 36 for a repeat of the process. Any number of pay zones may be hydraulically fractured by the present process in a single trip of the coiled. tubing string 18 and a sand plug is positioned at each pay zone. For the uppermost pay zone, an upper mechanical packer may not always be necessary as a hanger may be provided for wellhead 16 in some instances to provide sealing of the annulus as illustrated in FIG. 5. After the fracturing process is completed, the coiled tubing assembly is removed from the borehole or well. The sand in the wellbore may be removed by another coiled tubing unit using air or water to wash the sand from the borehole as illustrated in FIG. 5.

Figure 6:
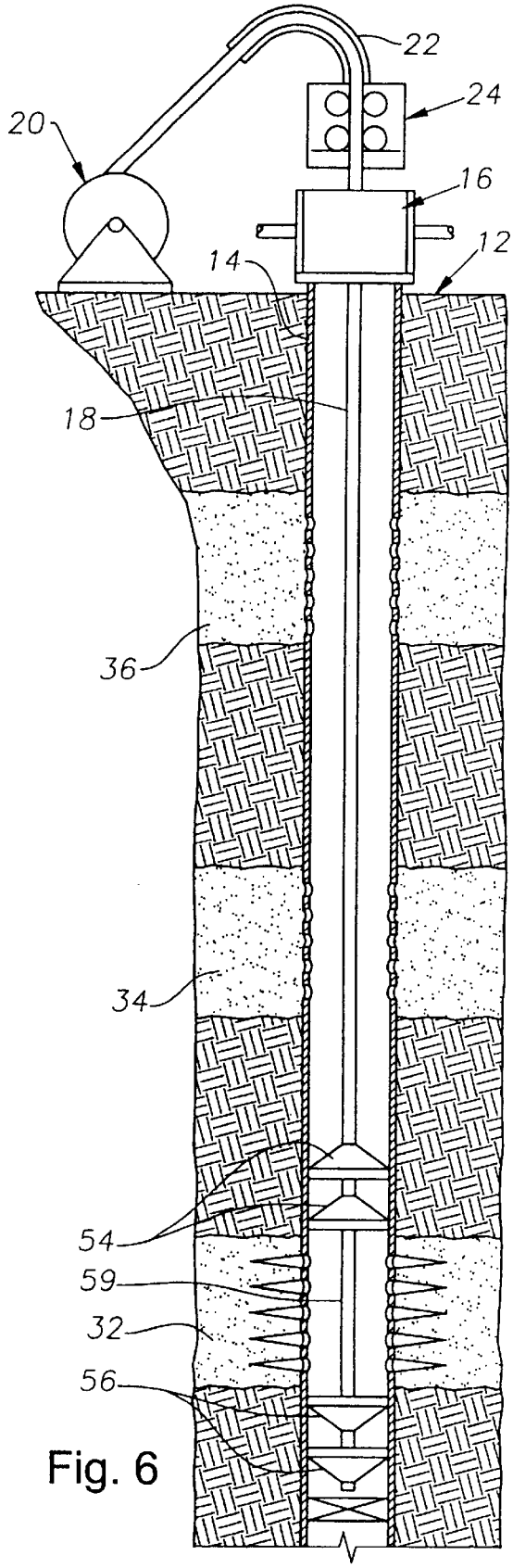
FIG. 6 is a schematic view of another embodiment of the invention in which the coiled tubing fracturing process utilizes upper and lower swab cups for isolating each of the pay zones in sequence from the lowermost pay zone.

Referring now to FIG. 6, the process of the present invention is shown with each pay zone 32, 34, 36 being isolated individually by opposed swap cups mounted on the coiled tubing string 18. A pair of inverted downwardly projecting swab cups 54 are mounted on coiled tubing string 18 for positioning above the upper side of pay zone 32 and a pair of upwardly directed swab cups 56 are mounted on coiled tubing string 18 for positioning below the lower side of pay zone 32. Swab cups 54, 56 do not have to be released and set for movement from one zone to another zone for isolating each zone individually and may be easily moved from one zone to another zone in a minimum of time by raising of tubing string 18. A suitable bottom hole assembly 59 is provided between upper and lower swab cups 54, 56 for discharge of the fracturing material into the adjacent formation.

Lower swab cups 56 are preferably spaced from upper swab cups 54 a distance at least equal to the thickness of the pay zone having the greatest thickness. Thus, the distances between swab cups 54 and swab cups 56 do not have to be adjusted upon movement from one pay zone to another pay zone. Swab cups which have been found to be satisfactory for use with the present invention are sold by Progressive Technology of Langdon, Alberta, Canada.

Figure 7:
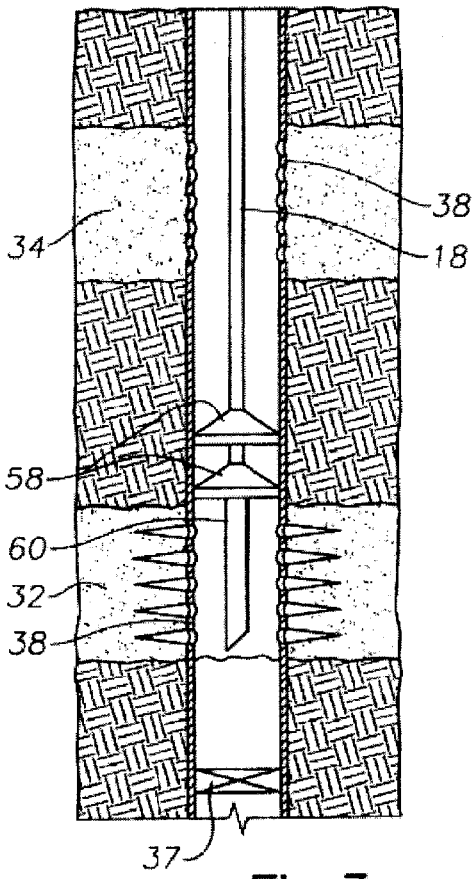
FIG. 7 is a schematic view of a further embodiment of the invention in which the coiled tubing fracturing process utilizes only upper swab cups for isolation of a pay zone with a sand plug utilized for isolating the lower end of the zone after hydraulic fracturing.
Figure 8:
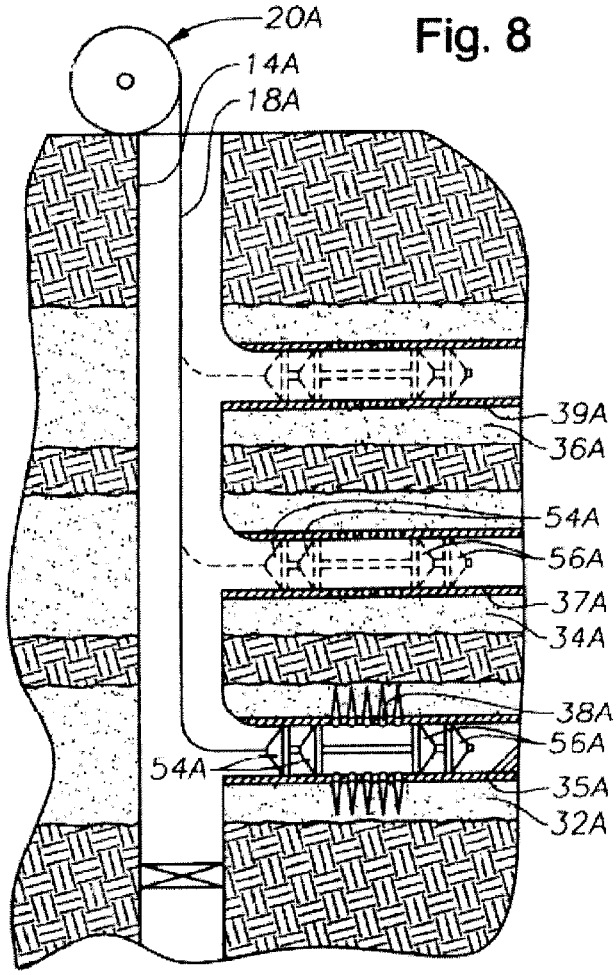
FIG. 8 is a schematic view of a further embodiment illustrating the coiled tubing fracturing process for a plurality of lateral bore portions extending to pay zones from a single vertical borehole.

As shown in the embodiment of FIG. 7, coiled tubing string 18 has a pair of inverted downwardly directed upper swab cups 58 mounted thereon for positioning above the upper side of pay zone 32. A bottom hole assembly 60 extends downwardly from upper swab cups 58. A sand plug is utilized for isolation of the lower side of pay zone 32 as in the embodiment shown in FIGS. 1–5. Coiled tubing 18 and swab cups 58 may be easily moved to the next superjacent pay zone without any release or setting of a packer. The process as shown in the embodiments of FIGS. 1–7 utilizes a single perforated casing for a plurality of vertically spaced pay zones. As shown in FIG. 8, the process of the present invention is shown for a borehole having a plurality of horizontally extending borehole portions defining pay zones 32A, 34A, and 36A. A vertical casing 18A has a plurality of lateral branches 35A, 37A, and 39A extending laterally from casing 18A within pay zones 32A, 34A, and 36A. Zones 32A, 34A, and 36A are hydraulically fractured in sequence. Innermost swab cups 54A and outermost swab cups 56A are mounted about coiled tubing 18A from reel 20A on opposite sides of perforations 38A of casing branch 35A which forms the farthermost casing branch. While outermost swab cups 56A are shown mounted on coiled tubing 18A, it may be desirable to provide a sand plug in lieu of outermost swab cups 56A as shown in FIG. 7. After fracturing of pay zone 32A, pay zones 34A and 36A are fractured in a similar manner.

Figure 9:
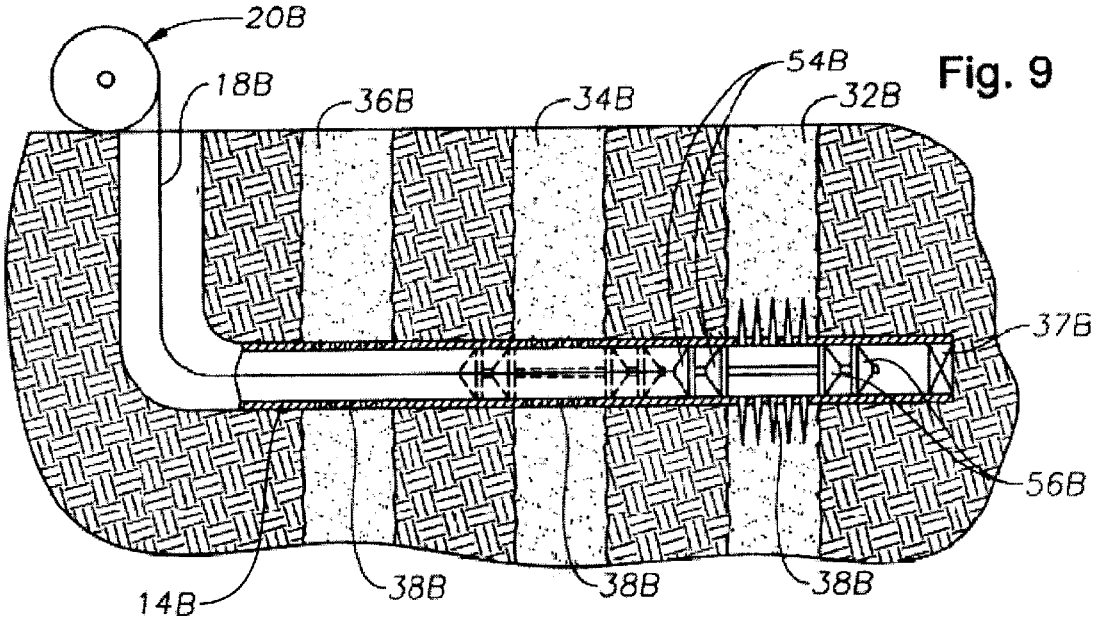
FIG. 9 is a schematic of another embodiment illustrating the coiled tubing fracturing process for a horizontal borehole having a plurality of separate pay zones.

As shown in FIG. 9, the process of the present invention is shown for a plurality of horizontally spaced pay zones 32B, 34B and 36B. Casing 14B has a plurality of perforated sections 38B in pay zones 32B, 34B and 36B and a bridge plug 37B adjacent the end of casing 14B. While farthermost swab cups 56B are shown mounted on tubing string 18A, it may be desired to substitute sand plugs for swab cups 56B as in the embodiment of FIG. 7. Coiled tubing string 18B. from reel 20B has inner swab cups 54B and outer swab cups 56B. Production or pay zones 32B, 34B and 36B are hydraulically fractured in sequence with each pay zone being individually isolated by swab cups. As used in the specification and claims herein, the term "outermost" pay zone is interpreted as including the lowermost and farthermost pay zones as shown in the various embodiments. In all of the embodiments of this invention, the casing is preferably perforated in a single pass of the wire line or coiled tubing as shown and described in FIG. 1, although in some instances multiple passes may be made.

The process of the present invention utilizes coiled tubing for hydraulic fracturing a formation having a plurality of separate pay or production zones to be individually fractured in a single pass of coiled tubing with each zone being isolated with sand plugs or swab cups. In some instances, it might be desirable to provide hydraulic fracturing for a selected one of the plurality of pay zones such as might be desirable if a pay zone was previously bypassed. Also, selected fracturing might be provided for multiple lateral wells such as shown in FIG. 8 of the invention. In some instances, the process may also be provided for an open or uncased borehole without perforation of the pay zones. The process is particularly adapted for relatively shallow wells such as less than about 8,000 feet and particularly for gas which might exist in bypassed pay zones. Heretofore, on new wells, a retrievable bridge plug was positioned below the bottom side of each of the pay zones which was relatively time consuming. For many applications of hydraulic fracturing with coiled tubing, a relatively shallow well or borehole less than about 3,000 feet is utilized with hydraulic fracturing at a pressure under about 7,500 psi.

Fiber-Based Additive For Friction Reduction

A fracturing fluid which has been found to have low friction properties and is utilized with this invention is shown in U.S. Pat. No. 5,501,275 dated Mar. 26, 1996, the entire disclosure of which is incorporated by this reference for all purposes. U.S. Pat. No. 5,501,275 shows a fiber-based additive that is used to control proppant flowback from a hydraulic fracture during production and to reduce surface pressure during injection. The following. friction calculations illustrate such a reduction:

| Inj. Rate | (Pounds of Proppant Added) PPA | Tubing ID | Δp psi/1000 ft |
|---|---|---|---|
| 18 | 9 | 2.44" | 37 |
| 25 | 7 | 2.76" | 48 |
| 32 | 5 | 2.70" | 62 |
| 35 | 5 | 3.24" | 9.5 |
| 40 | 6 | 2.75" | 84 |
| 40 | 7 | 2.76" | 13.8 |

However, even for comparable pipe sizes, injection rates and prop concs, a significant disparity in Δp is seen. This is attributed to the difficulty in accurately establishing friction from surface pressures and a detailed calculation is required prior to utilization of the fiber-based additive for friction reduction although it is clearly established that the fiber-base additive shown in U.S. Pat. No. 5,501,275 reduces friction. The '275 patent includes a porous solid pack of fibers and proppant which reduces the energy consumption of equipment and provide a significant reduction in frictional forces. The fiber length is at least about 2 millimeters and the fiber diameter ranges between about 3 to 200 microns. Glass fibers are particularly preferred although carbon fibers are oftentimes,preferred for harsh conditions. A proppant is normally utilized and may comprise a resin coated sand. Resin coated sand and fibers provide a strong pack.

Surfactant (VES) Fracturinq Fluid

Another fracturing material utilized with this invention which has been found to have a low friction is shown in U.S. Pat. No. 5,551,516 dated Sep. 3, 1996, the entire disclosure of which is incorporated by this reference for all purposes. U.S. Pat. No. 5,551,516 is directed to an aqueous viscoelastic surfactant (VES) fluid as a fracturing fluid. Commonly used fracturing fluids consist of water and the use of a gelling agent. The gelling agent normally is a polymer, such as guar or its derivatives. This polymer exists in the form of long molecular chains. These chains are then cross-linked to enhance the viscosity of a fracturing fluid. This increased viscosity is needed during fracturing but is undesirable for productivity of the wellbore and is preferably removed following the fracturing operation. This however is not easy and more than often, gel residue is left behind in the fracturing, which affects the well productivity.

A viscoelastic surfactant is a non-polymeric fluid. It relies on the use of a surfactant to develop viscosity. In contrast to the x-linked structure of a polymeric fluid, a VES fluid develops viscosity through the aggregation of which is referred to as micelles. This micellar structure however deteriorates when brought in contact with a hydrocarbon. The fluid thus naturally looses viscosity during production, leaving behind a clean proppant pack in the fracture.

The friction reducing characteristics of VES fluids have been shown in field practice. A comparative set of friction numbers for the VES fluid and a polymeric system (low-guar) identified as YF120LG , a low guar borate cross-linked fracture fluid sold by Dowell Schlumberger of Houston, Tex., with an injection rate of 9.5 bpm (barrels per minute) and a 1.34 inch internal diameter of coiled tubing is shown below:

| Fluid | Friction (psi/1000 ft) |
|---|---|
| YF120LG | 3,460 |
| VES | 1,170 |

VES is believed to have a low friction pressure resulting from a different rheological structure. VES provides a 100% retained permeability to permit a fracture treatment to be designed with a relatively small proppant concentration.

The aqueous viscoelastic surfactant comprises water, an inorganic salt stabilizer, a surfactant/thickener and an organic salt or alcohol. The fracturing fluid may optionally contain a gas such as air, nitrogen or carbon dioxide to provide an energized fluid or a foam. A small group of surfactants having unique viscoelastic properties make them of high interest for use in fracturing applications and find particular utility in forming fracturing fluids for fracturing treatment of high permeability subterranean formations.

In addition to the viscoelastic surfactant, the aqueous fracturing fluid requires a sufficient quantity of at least one water soluble inorganic salt to effect formation stability. Typically, water soluble potassium and ammonium salts, such as potassium chloride and ammonium chloride are employed. Additionally, calcium chloride, calcium bromide and zinc halide salts may also be used. Formation stability and in particular clay stability is achieved at a concentration level of a few percent by weight and as such the density of the fluid is not significantly altered by the presence of the inorganic salt unless fluid density becomes an important consideration, at which point, heavier inorganic salts may be employed.

A sufficient quantity of at least one surfactant/thickener soluble in the aqueous salt solution is employed to effect, in combination with an organic salt and/or alcohol, sufficient viscosity to suspend proppant during placement.

A sufficient quantity of a water soluble organic salt and/or alcohol is employed to effect, in combination with the thickener, the desired viscoelastic properties. Preferably the organic salt is water soluble carboxylate salt such as sodium or potassium salicylate or the like. Preferably the alcohol is a cosurfactant, typically a $C_4$ to $C_{12}$ aliphatic alcohol.

Other Fracturing Fluids

Two other fracturing fluids that exhibit a relatively lower friction pressure can also be used with coiled tubing fracturing operations. The first of these is the Xanthan-polymer based fracturing fluid. This fluid dampens turbulence which is developed at large flow velocities. Turbulence is the primary reason for friction pressure losses in the tubing during injection. A second such friction reducing fluid is the synergistic polymer blend. This fluid system is developed by mixing a particular proportion of the Xanthan and guar polymers. These fluids have a lower viscosity than YF120LG at the high shear rates that are encountered within the coil tubing. This lower viscosity is primarily responsible for the reduced friction during injection.

Coil tubing fracturing can alternatively be performed with additives that are included with the fracturing fluid to reduce friction during fluid injection. One such additive is sold under the name "UltraLube", and is commercially manufactured by Stavanger Fluids of Stavanger, Norway. The Ultralube additive reduces fluid friction by forming a lubricating coating on the internal walls of the coil tubing which reduces the fluid drag and hence friction pressure losses.

As indicated previously, a fracturing fluid utilized with coiled tubing in a fracturing operation is required to have a low friction which may vary dependent primarily on the diameter of the coiled tubing and the depth of the outermost pay zone. The following table sets forth the maximum friction in a fracturing fluid which can obtain satisfactory results for a particular OD of coiled tubing and a particular depth of the pay zone.

| Coiled Tubing OD (inches) | Depth of Pay Zone (feet) | Maximum Friction (psi/1,000 feet) |
|---|---|---|
| 1 ¾ | 3,000 | 4,560 |
| 2⅜ | 3,000 | 1,680 |
| 1¾ | 5,000 | 4,200 |
| 2⅜ | 5,000 | 1,200 |
| 1¾ | 8,000 | 3,700 |
| 2⅜ | 8,000 | 850 |

Specific Example

For testing of the process, a four well project with each of the wells having four pay zones to be fractured individually was selected having a shallow well depth of about 1,500 feet and utilizing coiled tubing of 2 ⅜ inch outer diameter. Each of the individual zones are isolated by a mechanical packer adjacent the upper end of each zone and a sand plug adjacent the lower end of each zone. Each of the pay zones was perforated prior to the beginning of the fracturing operation utilizing coiled tubing in one trip. Two types of packers were utilized as the upper packer. One of the packers was a Baker Model ADI Tension Packer sold by Baker Hughes, Inc. of Houston, Tex. The other upper packer was an inverted swab cup arrangement utilizing one or two downwardly facing cups in series to allow easy movement of the coiled tubing from one zone to another zone without having to mechanically set and unset the packer. A one meter tail pipe was suspended from the end of the coiled tubing. The fracturing material was pumped at a rate between about 1 and 1 ½ cubic meters a minute to initiate fracture breakdown and then the rate was increased for the remainder of the treatment to about 2 cubic meters per minute. The well was fractured with a suitable amount of fluid and proppant varying with the selected zone and increasing the concentration of sand. At the end of the pumping of the fractured fluid, the pump was switched to a flush position and sand was added to provide a suitable sand plug of about 20 to 30 meters in height. When the pump is shut down, the sand settled to create a sand plug across the perforations of the zone which was fractured. After testing of the sand plug, the packer was released and lifted to the next zone for hydraulic fracturing. The sand plug for each of the four pay zones was effective and a relatively fast sand placement was achieved.

In another test, an inverted swab cup was positioned about the coiled tubing above the pay zone. Thus, the utilization of coiled tubing for fracturing multiple relatively shallow pay zones with isolation provided by a mechanical packer and a sand plug for each zone was successfully completed. Further, utilizing swab cups in lieu of the mechanical packer and later in lieu of the sand plugs were found to be highly effective and resulted in a minimum of time in hydraulic fracturing of the plurality of zones as movement from one zone to another zone was minimized.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A process for perforating and fracturing a plurality of vertically spaced pay zones in a shallow vertically extending well having a depth less than about 3,000 feet comprising:

perforating the spaced pay zones with a perforating apparatus from an outermost pay zone to an innermost pay zone;

providing a coiled tubing apparatus including a reel and injector for inserting a coiled tubing string from the reel in the well;

positioning a packer on the coiled tubing string for positioning on the upper side of a selected pay zone for isolating the pay zone;

inserting the coiled tubing within the well and positioning the packer adjacent the upper side of the outermost perforated pay zone;

injecting a fracturing material having a low friction from the coiled tubing string within the outermost perforated pay zone;

then injecting sand from said coiled tubing string into the pay zone after injection of said fracturing material to form a sand plug covering the outermost perforated pay zone;

then raising the coiled tubing string to the next superjacent perforated pay zone with the packer isolating the next superjacent perforated pay zone;

then injecting a fracturing material having a friction of less than about 4,650 psi/1,000 feet from the coiled tubing string within the next superjacent perforated pay zone;

then injecting sand from said coiled tubing string into the next superjacent pay zone to form a sand plug covering the next superjacent perforated pay zone; and repeating the acts of raising the coiled tubing string, injecting a fracturing material, and then injecting sand for all remaining perforated pay zones in the shallow well.

2. The process as set forth in claim 1 wherein positioning the packer on the coiled tubing string comprises positioning a swab cup on the coiled tubing string.

3. The process as set forth in claim 1 wherein positioning the packer on the coiled tubing string comprises positioning a mechanical packer on the coiled tubing string which is released and reset upon movement of the coiled tubing string from one pay zone to another pay zone.

4. The process as set forth in claim 1 herein injecting the fracturing material comprises injecting a viscoelastic surfactant fracturing fluid having a low friction.

5. The process as set forth in claim 1 wherein injecting the fracturing material comprises injecting a fracturing fluid having a fiber-based additive to provide a low friction.

6. The process as set forth in claim 1 wherein injecting the fracturing material comprises injecting the fracturing material within coiled tubing having an outer diameter of 1 ¾ inches.

7. The process as set forth in claim 1 wherein injecting the fracturing material comprises injecting a fracturing material having a friction less than 1,680 psi/1,000 feet within coiled tubing having an outer diameter of 2 ⅜ feet.

8. A process for perforating and fracturing a plurality of vertically spaced pay zones in a shallow vertically extending gas well having a depth less than about 5,000 feet comprising the steps of:

perforating the spaced pay zones with a perforating apparatus;

providing a coiled tubing apparatus including a reel and injector for inserting coiled tubing from the reel in the well;

positioning a pair of opposed spaced swab cups on the coiled tubing for positioning on opposed sides of a selected pay zone for isolating the pay zone;

inserting coiled tubing having an outer diameter of 2 ⅜ inches within the well and positioning the swab cups on opposite sides of the lowermost perforated pay zone;

injecting a fracturing material having a friction less than about 1,200 psi/1,000 feet from the coiled tubing within the lowermost perforated pay zone;

then raising the coiled tubing to the next superjacent perforating pay zone with the swab cups isolating the next superjacent perforated pay zone;

then injecting the fracturing material having a friction less than about 1,200 psi/1,000 feet from the coiled tubing within the next superjacent perforated pay zone; and repeating the steps of raising the coiled tubing and injecting said fracturing material for all remaining perforated pay zones in the shallow well.

9. The process as set forth in claim 8 including the steps of:

mounting said pair of swab cups on the coiled tubing in a spaced relation to each other at least equal to the width of the maximum pay zone so that said coiled tubing can be raised in successive steps from the lowermost pay zone to the uppermost pay zone without changing the spacing between the swab cups.

* * * * *